United States Patent [19]

Southam

[11] Patent Number: 4,628,986

[45] Date of Patent: Dec. 16, 1986

[54] MOLDING REGISTER SYSTEM

[75] Inventor: Donald L. Southam, Brecksville, Ohio

[73] Assignee: Combustion Engineering, Inc., Windsor, Conn.

[21] Appl. No.: 716,294

[22] Filed: Mar. 26, 1985

[51] Int. Cl.[4] ..... B22C 9/00

[52] U.S. Cl. ..... 164/159; 164/168; 164/323; 164/375; 164/385

[58] Field of Search ..... 164/29, 137, 168, 181, 164/185, 205, 224, 339, 364, 375, 159, 169, 322, 323, 384, 385, 388

[56] References Cited

U.S. PATENT DOCUMENTS

| | | | |
|---|---|---|---|
| 3,517,728 | 6/1970 | Taccone | 164/339 |
| 4,202,403 | 5/1980 | Miller | 164/339 |
| 4,261,413 | 4/1981 | Blower et al. | 164/159 |

*Primary Examiner*—Nicholas P. Godici

*Assistant Examiner*—Richard K. Seidel

*Attorney, Agent, or Firm*—Robert L. Olson

[57] ABSTRACT

A register system is provided for making molds for metal casting which reduces flaws attributable to parting line shift. This is accomplished by urging the cope mold flask (11) against two fixed stops (50, 52) on the long axis, and one fixed stop (54) on the short axis of the flask. This same register principle is applied in the drag mold making station 18, where the drag flask (15) is urged against two fixed stops (100, 102) on the long axis, and one fixed stop (90) on the short axis of the flask. At the closer station (24), where the mold halves are assembled, they are again urged against two fixed stops (134, 136) on the long axis, and one fixed stop (142) on the short axis of the flasks. Thus the flasks are properly aligned to the patterns at the mold making stations, and again properly aligned to each other at the closer station, so as to eliminate parting line shift problems of the mold halves.

3 Claims, 15 Drawing Figures

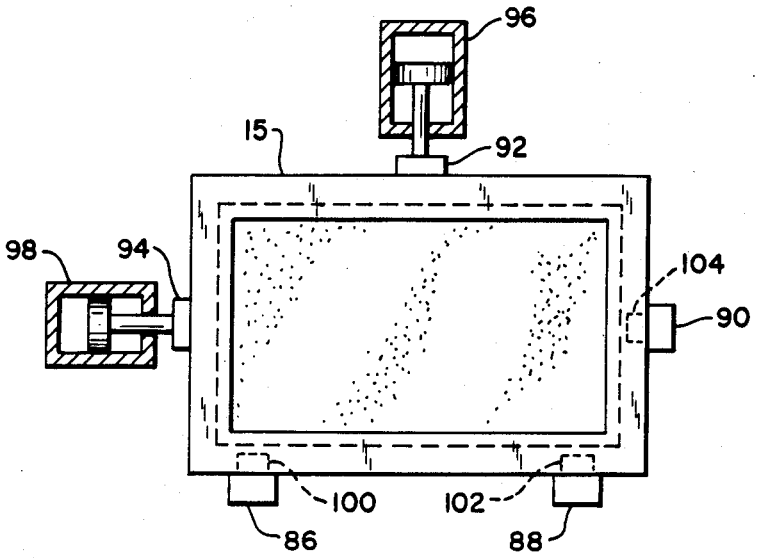
FIG. 9
FIG. 11
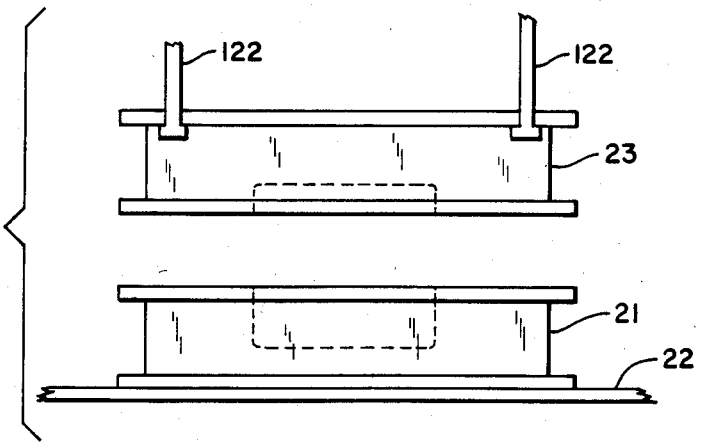

MOLDING REGISTER SYSTEM

BACKGROUND OF THE INVENTION

In conventional molding practice, alignment of the flask to the pattern, and flask-to-flask, is achieved by means of pins and bushings. More specifically, in most instances pins are provided on the pattern which can engage bushings on the drag flask at the mold making station. These same bushings are then used to engage pins on the cope flask at the closing station, where the drag and cope flasks are assembled. The above achieves the alignment requirement for patterns to flask, and flask-to-flask.

One of the problems frequently encountered in conventional molding systems is a casting flaw attributable to parting line shift. One of the principle causes of this casting defect is the general problem associated with the clearances required between pins and bushings, and the increase in those clearances caused by wear on these critical alignment parts. Typically, clearances on the order of ten thousandths of an inch are required between pattern pins and their mating bushings on the drag in order to prevent binding action as the flask is lowered onto the pattern or later on when it is drawn. Similar clearances are required in making the cope, and the same clearances are also then encountered in the match between the cope and the drag.

In addition to these initial clearances, it is not uncommon to see wear on pins and/or bushings which can often accumulate to an additional ten thousandths of an inch. It can therefore be seen that with worn pins and bushings, a drag might be shifted relative to its pattern as much as fifteen thousandths from a theoretical true desired position. Similarly, a cope can be shifted to a corresponding amount, but in the opposite direction. When the cope and drag are eventually closed, an error of as much as forty-five thousandths can occur between the cope and drag parting surfaces from these variables alone.

SUMMARY OF THE INVENTION

In accordance with the invention, a register system is provided to eliminate the errors caused by pin and bushing clearances and wear. The register scheme is achieved by urging the rectangular flask to two fixed surfaces (or one long surface) on the long axis and one fixed surface on the shorter axis of the flask. This register principle is applied in both the cope and drag mold making locations, and also the closer location, where the mold halves are assembled, and utilizes the same flask surfaces for all registration purposes.

BRIEF DESCRIPTION OF THE DRAWINGS

FIG. 9 is a plan view taken on lines 9—9 of FIG. 7, showing the register system of the invention;

FIG. 11 is a view showing the closer station, where the mold halves are assembled;

DESCRIPTION OF THE PREFERRED EMBODIMENT

Figure 1:
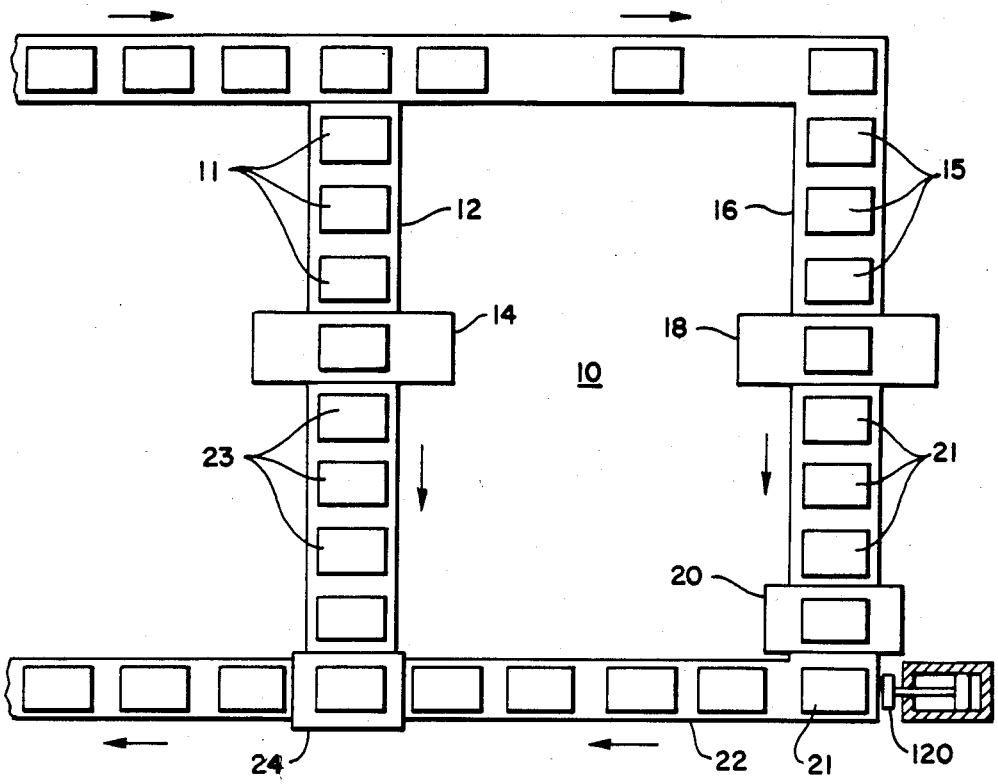
FIG. 1 is a schematic of a mold making assembly incorporating the register system of the invention.

Looking now to FIG. 1, numeral 10 designates a mold making assembly line in its entirety. Empty flasks 11 returned from the casting station enter the cope mold making conveyor line 12, where they are positioned over a pattern board, filled with sand, and the sand compacted, at the cope mold making station 14. Similarly, empty flasks 15 returned from the casting station enter the drag mold making line 16, where they are positioned over a pattern board, filled with sand, and the sand compacted, at the drag mold making station 18. The drag flasks then pass through a rollover station 20, where they are turned over, so that the pattern side is facing up.

The drag molds 21 after being rolled over, move along conveyor line 22 to the closer station 24. During this travel, cores are usually placed in the drag mold halves. At the closer station 24, the cope molds 23 are brought in above the drag mold halves, and positioned thereon, forming a complete mold, having a horizontal parting line, ready to be moved along the conveyor line to the pouring station, where a casting is poured. The movements of the various conveying lines 12, 16, and 22 are all coordinated, so that they move together. Thus for example every 30 seconds which would be the indexing period, the flasks are moved ahead one step in the conveyor line. Since conveyor 22 carries the mold halves in a direction corresponding to their long axis, and conveyors 12 and 16 moves the mold halves in a direction corresponding to their short axis, conveyor 22 will move correspondingly further during each indexing period. Alternatively, conveyor 22 can move continuously. In this case, provision is made typically at units 21 and 24 to synchronize with the continuously moving conveyor.

Figure 2:
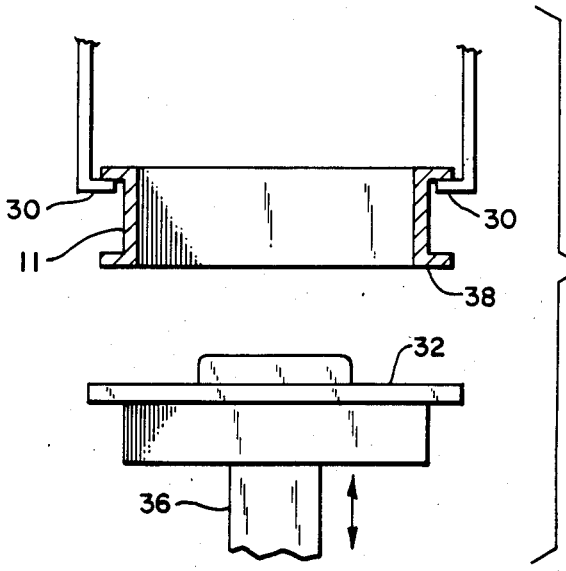
FIG. 2 is a view of the cope mold making station.
Figure 3:
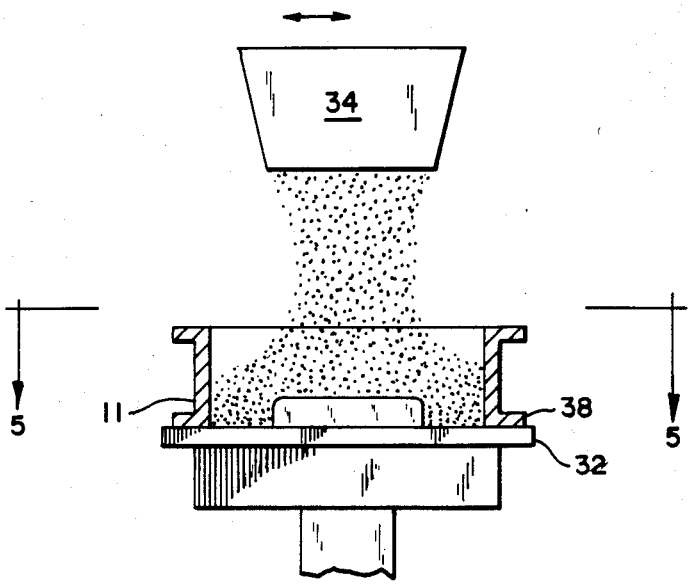
FIG. 3 is a view similar to FIG. 2, with the cope flask in the sand fill position.

Looking now to FIGS. 2–5, more of the details of the cope mold making station 14 is shown. As can be seen in FIG. 2, a cope flask 11 is brought into the molding station 14 in any suitable manner, for example by fingers 30, which can be supported by movable overhead structure. The fingers 30 bring the flask 11 into a position above the pattern board 32, and stops. A piston-cylinder arrangement in a stanchion 36 then raises the pattern board 32 into contact with the lower flange 38 of the flask. At this time, the register system of the invention accurately positions the flask with respect to the pattern, as will be described in greater detail below. Looking now to FIG. 3, after the flask 11 has been positioned on the pattern board 32, the fingers 30 are caused to overtravel and thereby disengage from the flask and the register system accurately positions the flask relative to the pattern. At this time, a sand supply 34 fills the flask with sand. The sand supply 34 is then shuttled back to a position out of the way, and a squeezing mechanism 42 (FIG. 4) is shuttled in above the flask. The sand supply 34 and the squeezing mechanism 42 can be mounted on the same overhead mechanism (not shown) so that they can be alternately shuttled back and forth from opposite sides by any suitable means.

Figure 4:
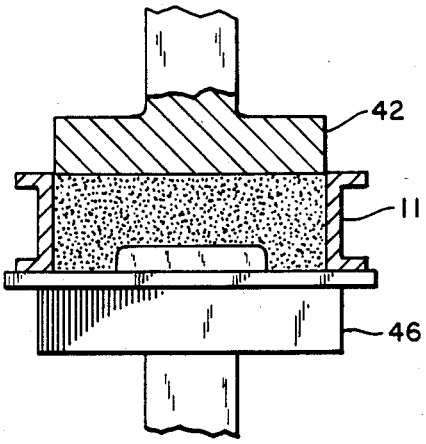
FIG. 4 is a view similar to FIG. 3, showing the cope flask in the sand compaction position.

Looking now to FIG. 4, the squeezing mechanism 42 is moved downwardly into contact with the upper sand surface by means of a piston-cylinder arrangement connected to shaft 44, thus exerting a large force to this surface, while at the same time table 46 subjects the sand to a jolting or rapping action by any suitable means, such as an air or hydraulic motor, thus compacting the sand, which contains enough binder material, such as clay, to form a semi-hard mold within the flask. The finished mold half, still carried in its flask, is then moved out of the mold forming station 14 (FIG. 1) after the squeezing mechanism 42 has been raised out of the way. All of the above is accomplished during one indexing time period, such as 30 seconds.

Figure 5:
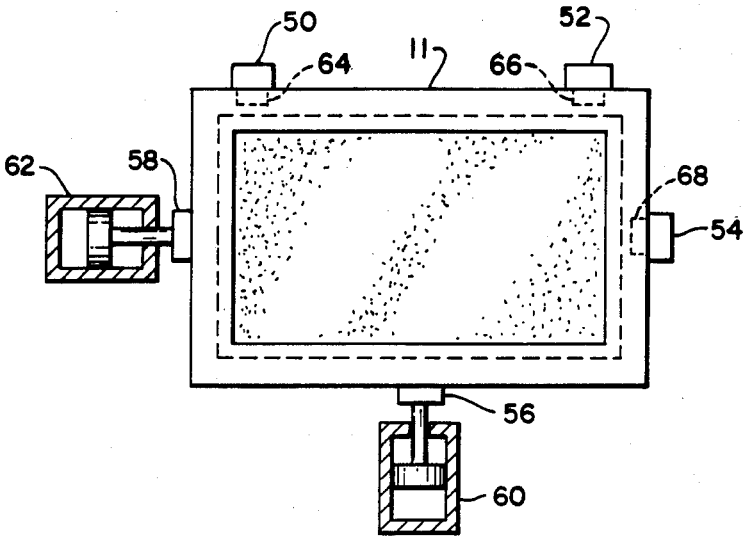
FIG. 5 is a plan view taken on lines 5—5 of FIG. 3, showing the register system of the invention.
Figure 6:
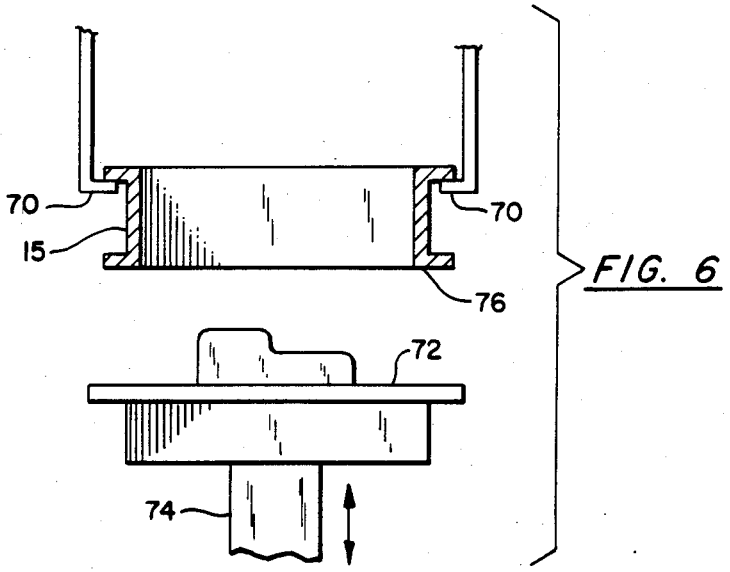
FIG. 6 is a view of the drag mold making station.
Figure 7:
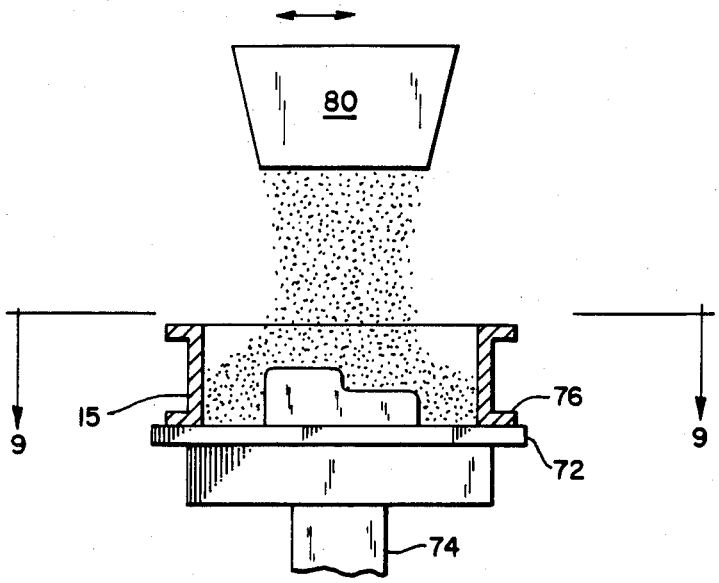
FIG. 7 is a view similar to FIG. 6, with the drag flask in the sand fill position.
Figure 8:
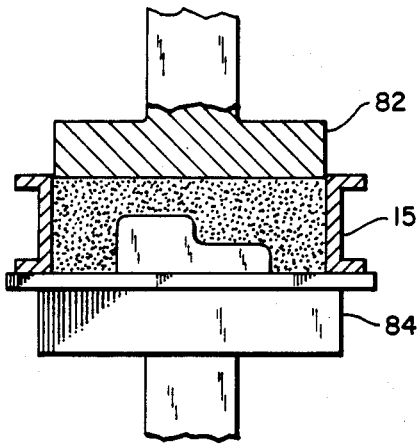
FIG. 8 is a view similar to FIG. 7, showing the drag flask in the sand compaction position.

Looking now to FIG. 5, the register system at the cope mold forming station 14 will be described. After the empty flask 11 has been set down on the pattern board 32, and the fingers 30 have released it, a pair of stop members 50, 52 lying along one side of the flask, and a third stop member 54, are employed to accurately locate the flask. The stop members are typically mounted on the pattern or pattern support holster. A pair of pusher members 56 and 58 are used to move the flask to the stop members. The piston-cylinder actuator 60 for pusher 56 is then actuated, so as to push the flask over until it contacts stops 50, 52. Actuator 62 is then actuated, so that pusher member 58 moves the flask 11 into contact with stop 54. At this time, the flask 11 has been accurately indexed, or positioned, with regard to the pattern, and the sand can thereafter be poured in, and the cope mold can be finished. Hardened steel wear plates 64, 66 and 68 can be attached onto the sides of the flask 11 to coact with stop members 50, 52 and 54, so that they do not quickly wear at these points.

Looking now to FIGS. 6–9, the drag mold making station is shown in more detail. Similarly to what is done in the cope mold making station, a drag flask 15 is brought into the molding station 18 in any suitable manner, for example by fingers 70, which can be supported by movable overhead structure. The fingers bring the flask 15 into a position above the pattern board 72, and stops. A piston-cylinder arrangement in stanchion 74 raises the pattern board 72 into contact with the lower flange 76 of the flask. At this time, the register system of the invention accurately positions the flask with respect to the pattern as will be described in greater detail with regard to FIG. 9. Looking now to FIG. 7, after the flask 15 has been positioned on the pattern board 72, the register system then accurately positions the flask relative to the pattern. At this time, a sand supply 80 fills the flask with sand. The sand supply 80 is then shuttled back to a position out of the way, and a squeezing mechanism 82 (FIG. 8) is shuttled in above the flask. The squeezing mechanism 82 is moved downwardly into contact with the upper sand surface, while jolting the flask 15 by means of table 84 to compact the sand. The finished mold half is then moved on, to the rollover station 20 (FIG. 1), after the squeezing mechanism has been raised.

Looking now to FIG. 9, the register system at the drag mold forming station 18 will be described. After the empty flask 15 has been set down on the pattern board 72, and the fingers 70 have disengaged, a pair of stop members 86, 88 lying along one side of the flask, and a third stop member 90, are employed. These stop members like those of FIG. 5, are typically mounted on the pattern or pattern support holster. A pair of pusher members 92 and 94 are employed to move the flask into position. The piston-cylinder actuator 96 for pusher 92 is then actuated, so as to push the flask over until it contacts stops 86, 88. Actuator 98 is then actuated, so that pusher member 94 moves the flask 15 into contact with stop 90. At this time, the flask 15 has been accurately indexed, or positioned, with respect to the pattern, and the sand can thereafter be poured in and the drag mold can be finished. Hardened steel wear plates 100, 102 and 104 may be attached onto the sides of the flask 15 to coact with the stops 86, 88 and 90, so that they do not quickly wear out at these points. The stops can also be made of hardened steel. As can be seen, the register system for the drag molds is exactly the same as that for the cope molds, with one major exception. Since the drag molds are rolled over in rollover station 20 (FIG. 1), the stops 86, 88 are in the lower portion of FIG. 9, whereas stops 50, 52 are in the upper portion of FIG. 5. When the drag molds enter the closer station 24 (FIG. 1), the indexing or registry points of both the cope and drag flasks will coincide at the parting face flanges.

Figure 10A:
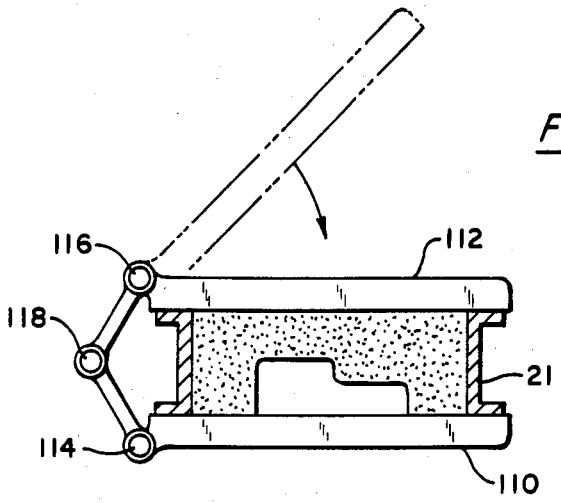
FIGS. 10*a*, 10*b*, and 10*c* shows the rollover station, for the drag flasks.
Figure 10B:
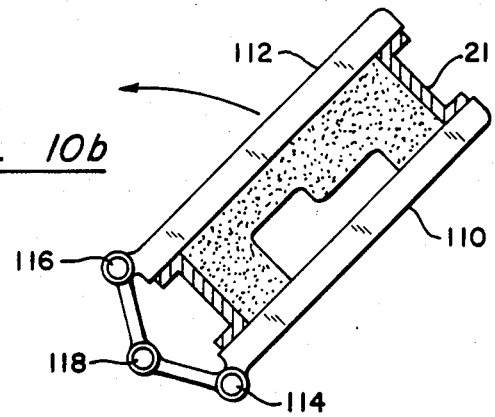
Figure 10C:
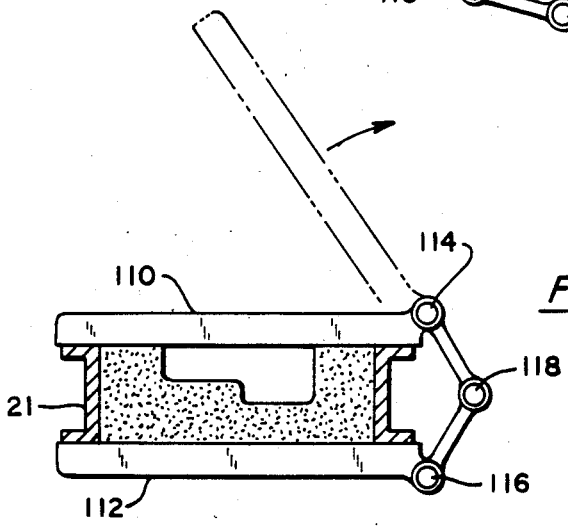

Looking now to FIGS. 10*a*, 10*b* and 10*c* the rollover station 20 is shown in more detail. A pair of jaws 110, 112 are each separately pivotable about its own pivot point 114, 116 respectively. In addition, both arms or jaws can be rotated together about pivot 118. When a flask 21 moves into the rollover station 20, jaw 110 is in its horizontal position as seen in FIG. 10*a*, and jaw 112 is in its upward position, shown in dashed lines. After the flask has been placed on lower jaw 110, upper jaw 112 is rotated clockwise about pivot point 116, so that the flask is tightly gripped or secured between the two jaws. The entire assemblage is then rotated approximately 180° counter-clockwise about shaft 118 (FIG. 10*b*), as to place the flask in alignment with the end of conveyor 22 (FIG. 1). Jaw 110 is then rotated upwardly about pivot 114 (FIG. 10*c*). A pusher member 120 (FIG. 1) is then actuated, which pushes the flask onto the conveyor 22. The jaws are then rotated back to the their original position, so as to be ready for the next flask coming from the drag mold making station 18.

Figure 12:
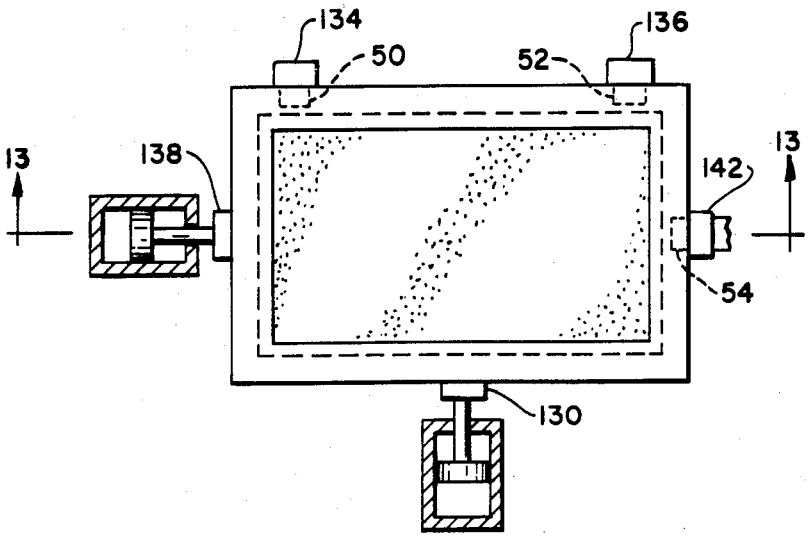
FIG. 12 is a plan view of the closer station showing the register system of the invention.
Figure 13:
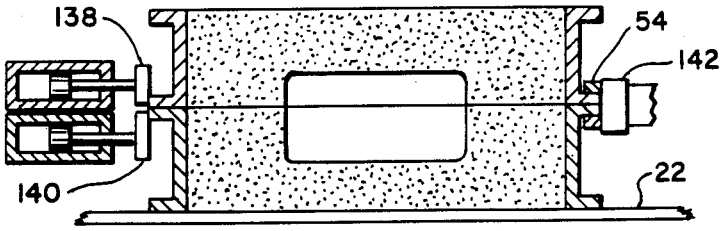
FIG. 13 is a view taken on lines 13—13 of FIG. 12.

Looking now to FIG. 11, the closing station 24 (FIG. 1) is shown, where the cope and drag mold halves are assembled. The drag mold flask 21 is indexed into the closing station by the conveyor 22. Likewise, the cope mold flask 23 is brought in above the drag flask by means of fingers 122, which are carried by overhead support apparatus in any well known manner. On the long axis, the registry apparatus of the invention 138 and 142 is swung into place. As seen in FIGS. 12 and 13, a pair of pusher members 130, one above the other, moves both flasks individually over against a pair of stops 134, 136 located on the long side of the flasks. Also, a pair of pushers 138, 140, one above the other, moves both flasks individually over against stop member 142. Like the situation in the cope mold and drag mold making stations, the same hardened steel wear plates 50, 52 and 54 on the cope flask, and the corresponding plates on the drag flasks, result in a long wear life for these registry points. In operation, the lower pusher 140 and 130 is actuated to move the drag flask to the common stops 134, 136 and 142. As the cope flask 23 is lowered, the upper cylinders 130 and 138 are actuated to bring the cope to the common stops 134, 136 and 142.

By employing separate pusher members for the cope and drag molds in both directions, a cope flask which has a larger or smaller flange than the drag flask can be accommodated. The register plate or stop is located so as to engage the exact same flask surfaces as were engaged in the cope and drag mold making stations. In this manner, each flask is relocated to a common reference, and is thereby accurately located relative to one another.

I claim:

1. In a mold making apparatus in combination, first mold making means for making cope mold halves, said first mold making means including a four sided metal cope flask, a first pattern, first register means for accurately positioning the cope flask relative to the first pattern by moving the cope flask so that a first reference means on one side of the cope flask is snug against a first stop means, second register means for accurately positioning the cope flask relative to the first pattern by moving the cope flask so that a second reference means on an adjacent side of the cope flask is snug against a second stop means, means for thereafter filling the cope flask with sand and compacting it, second mold making means including a four sided metal drag flask, a second pattern, third register means for accurately positioning the drag flask relative to the second pattern by moving the drag flask so that a first reference means on one side of the drag flask is snug against a third stop means, fourth register means for accurately positioning the drag flask relative to the second pattern by moving the drag flask so that a second reference means on an adjacent side of the drag flask is snug against a fourth stop means, means for thereafter filling the drag flask with sand and compacting it, a closer station, means for moving the drag flask to the closer station and positioning it with its cavity side up, means for moving the cope flask to the closer station and positioning it on top of the drag flask so that the two cavities match, and fifth register means for accurately positioning the cope flask relative to the drag flask by moving the drag flask and the cope flask so that the first reference means of both are snug against a fifth stop means, and sixth register means for accurately positioning the cope flask relative to the drag flask by moving the drag flask and the cope flask so that the second reference means of both are snug against a sixth stop means, so that there is no parting line shift between the mold halves in the completed mold.

2. The mold making apparatus set forth in claim 1, wherein the fifth and sixth register means moves the cope and drag flasks individually.

3. The mold making apparatus of claim 2, wherein the first reference means on both the cope and drag flasks comprise a pair of spaced apart plates integral with said one side of both of the flasks.

* * * * *